US010876718B2

(12) United States Patent
Cramer, Jr. et al.

(10) Patent No.: US 10,876,718 B2
(45) Date of Patent: Dec. 29, 2020

(54) LIGHT BASE

(71) Applicant: Hubbell Incorporated, Shelton, CT (US)

(72) Inventors: Charles R. Cramer, Jr., Kerrville, TX (US); Robert Wilton Fox, Greenback, TN (US); Michael Edward Fisher, Knoxville, TN (US); Brianna Joelle Vanderveen, Knoxville, TN (US)

( * ) Notice: Subject to any disclaimer, the term of this patent is extended or adjusted under 35 U.S.C. 154(b) by 0 days.

(21) Appl. No.: 16/152,024

(22) Filed: Oct. 4, 2018

(65) Prior Publication Data

US 2019/0101270 A1 Apr. 4, 2019

Related U.S. Application Data

(60) Provisional application No. 62/567,892, filed on Oct. 4, 2017.

(51) Int. Cl.

| | |
|---|---|
| ***F21S 8/02*** | (2006.01) |
| ***F21V 21/02*** | (2006.01) |
| ***F21V 15/01*** | (2006.01) |
| ***F21V 21/04*** | (2006.01) |
| *F21W 111/06* | (2006.01) |

(52) U.S. Cl.

CPC ..... *F21V 21/02* (2013.01); *F21S 8/022* (2013.01); *F21V 15/01* (2013.01); *F21V 21/04* (2013.01); *F21W 2111/06* (2013.01)

(58) Field of Classification Search

CPC ..... F21V 21/02; F21V 21/04; F21V 15/01; F21S 8/022; F21W 2111/06

See application file for complete search history.

(56) References Cited

U.S. PATENT DOCUMENTS

| | | | | |
|---|---|---|---|---|
| 2,184,004 A * | 12/1939 | Pennow | B64F 1/20 | 362/267 |
| 3,760,234 A * | 9/1973 | Jones | G01R 11/04 | 361/666 |
| 4,382,274 A * | 5/1983 | De Backer | B64F 1/20 | 340/815.76 |
| 4,878,782 A | 11/1989 | Beattie | | |
| 5,029,054 A | 7/1991 | Trainor | | |
| 5,081,804 A * | 1/1992 | Andersson | E02D 27/42 | 405/236 |

(Continued)

FOREIGN PATENT DOCUMENTS

WO 2016/168497 A1 10/2016

OTHER PUBLICATIONS

ADB Airfield Solutions Airport Light Bases and Transformer Housings, obtained from the Internet [www.abd-air.com] on Oct. 4, 2017.

(Continued)

*Primary Examiner* — Donald L Raleigh

(74) *Attorney, Agent, or Firm* — Verrill Dana, LLP; John W. Powell

(57) ABSTRACT

A light base configured to be installed in the ground and to receive a light fixture to be mounted thereon, comprises a hollow body member having a first end, a second end opposite the first end, and an interior region between the first and second ends. The first end includes a first opening which is in communication with the interior region and which is configured to receive a light fixture. The hollow body member is formed of a polymer concrete material.

18 Claims, 8 Drawing Sheets

(56) References Cited

U.S. PATENT DOCUMENTS 5,431,510 A * 7/1995 Reinert, Sr. ..... B64F 1/20 404/26
5,582,477 A * 12/1996 Reinert, Sr. ..... B64F 1/20 174/38
5,585,611 A 12/1996 Harvey
5,785,409 A * 7/1998 Reinert, Sr. ..... B64F 1/20 174/57
6,027,283 A 2/2000 Schweinberg et al.
6,550,931 B1 * 4/2003 Olson, Jr. ..... B64F 1/20 362/153
6,685,333 B1 * 2/2004 Bieberdorf ..... B64F 1/20 362/153.1
6,784,357 B1 * 8/2004 Wang ..... F21S 8/086 136/244
6,840,649 B2 * 1/2005 Reinert, Sr. ..... B64F 1/20 362/153.1
6,912,408 B1 * 6/2005 O'Neill ..... H01Q 1/12 343/890
7,201,490 B1 * 4/2007 Bieberdorf ..... B64F 1/20 362/153
9,296,527 B2 3/2016 Schweinberg et al.
2003/0235054 A1 * 12/2003 Ruggles ..... A01G 9/02 362/431
2004/0242034 A1 12/2004 Rinehart et al.
2006/0232957 A1 * 10/2006 Bieberdorf ..... B64F 1/20 362/153.1
2008/0199682 A1 * 8/2008 Browne ..... E01D 2/00 428/319.1
2010/0277901 A1 * 11/2010 Farchtchian ..... F21V 29/77 362/227
2015/0103518 A1 * 4/2015 Zhu ..... F21S 9/037 362/183
2016/0069039 A1 3/2016 Johnson et al.
2017/0040789 A1 2/2017 Bonilla et al.
2017/0252256 A1 * 9/2017 Henshue ..... A61H 3/061

OTHER PUBLICATIONS

Jaquith Industries, Inc. L867 Class 1B Light Base Technical Specs. Flier, obtained from the Internet [www.jaquith.com] on Oct. 4, 2017.

* cited by examiner

LIGHT BASE

CROSS-REFERENCE TO RELATED APPLICATION

This application claims the benefit of priority to U.S. Provisional Application No. 62/567,892, filed Oct. 4, 2017, which is incorporated herein by reference.

FIELD OF THE INVENTION

The invention relates to a base for a lighting fixture and more specifically to such a light base, which is installed in the ground for applications including runway and tarmac lighting at airports.

BACKGROUND OF THE INVENTION

Federal Aviation Administration (FAA) regulated airports throughout the United States use specialized lighting adjacent to runways and tarmacs, which require a grade-level light base/canister installed at a certain depth into the ground. The canister provides a mounting point for a lighting fixture and it provides housing for the necessary electrical connections. The bases are cylindrical in shape, with a typical height of approximately 24 inches, and they may have different diameters (e.g. 12, 16, and 24 inches) to accommodate different size lighting fixtures. They have a wall thickness that may vary depending on the load requirements specified by the FAA. One such base is an FAA Type L-867 (Class IA and Class IB), which is typically fabricated from an appropriate metal, such as ASTM A36 steel, which may be galvanized to provide corrosion resistance, and constructed in such a manner to meet the designated testing requirements.

The light base has a top end which is open to allow access to the inside of the cylindrical enclosure as well as to provide a mounting surface that receives and supports an elevated navigational light or a cover which seals the light base. The light base is installed by placing the bottom end down on compacted earth and a circular protective base plate may be placed over the bottom end to enclose the components which will be housed in the base. Concrete or a bituminous material is then poured around the light base into a form such as a SonoTube®, as a part of the installation to provide additional strength to the base. While the concrete is required for strength, it increases the complexity and cost of installation.

After installation, exposure to moisture, caustic solutions, surrounding soil or pavement, acidity, snow and ice removal, and exposure to de-icing chemicals used on planes, the metal/galvanized steel of the light base may become chipped/broken and/or begin to deteriorate. The result is that these light bases have useful lifespans as short as ten years.

BRIEF DESCRIPTION OF THE INVENTION

It is an object of this invention to provide an improved light base which may be easily and inexpensively installed in the ground.

It is another object of this invention to provide a light base which will resist corrosion in the ground.

In one aspect, the invention includes a light base configured to be installed in the ground and to receive a light fixture to be mounted thereon. The light base comprises a hollow body member having a first end, a second end opposite the first end, and an interior region between the first and second ends. The first end includes a first opening which is in communication with the interior region and which is configured to receive a light fixture. The hollow body member is formed of a polymer concrete material.

In other aspects of the invention, one or more of the following features may be included. The hollow body member may be cylindrical in shape. The first end may include a first circular flange which defines the first opening. The first circular flange may be formed of polymer concrete. There may further be included a base member at the second end of the hollow body member. An outside diameter of the first circular flange may be less than an outside diameter of the base member. The outside diameter of the base member may be tapered and increase from a first end of the base member to a second end of the base member proximate the second end. There may further be included a base plate configured to be removably connected to the hollow body member at the second end. The base plate may include an aperture therein to drain liquid contained in the interior region of the hollow body member. There may further be included a hollow cylindrical extension member configured to be removably affixed to the first circular flange to extend a length of the hollow cylindrical body member. The hollow cylindrical extension member may include a third end, a fourth end opposite the third end, and an interior region between the third and fourth ends; and the third end may include a circular flange configured to mate with the first circular flange of the hollow cylindrical body member when the hollow cylindrical extension member is removably affixed to the first circular flange. The second end may include a second circular flange and the second circular flange may define the second opening in the hollow body member in communication with the interior region. The second flange may be formed of polymer concrete. The base member may include the second circular flange. The base plate may be configured to be removably affixed to the second circular flange.

In further aspects of the invention, one or more of the following features may be included. The hollow body member may be cylindrical in shape. The first end may include a first circular flange on which is removably mounted a circular ring cover having formed therein the first opening. The first circular flange and the circular ring cover may be formed of polymer concrete. An outside diameter of the hollow cylindrical body member may be tapered and decrease from the first end to the second end. There may be a base integrally formed at the second end of the hollow body member. The base may include an aperture therein to drain liquid contained in the interior region of the hollow body member. The hollow body member may include an outer surface on which are disposed a plurality of ribs extending in a direction substantially parallel to the longitudinal axis of the hollow body member and the thickness of the ribs may decrease from the first end to the second end of the hollow body member. There may further be included a hollow cylindrical extension member configured to be removably affixed to the first circular flange to extend a length of the hollow cylindrical body member. The hollow cylindrical extension member may include a third end, a fourth end opposite the third end, and an interior region between the third and fourth ends. The third end may include a circular flange configured to mate with the first circular flange of the hollow cylindrical body member when the hollow cylindrical extension member is removably affixed to the first circular flange and the third end includes the first opening.

These and other features of the invention will be apparent from the following detailed description and the accompanying figures, in which:

BRIEF DESCRIPTION OF THE FIGURES

Embodiments of the present disclosure will now be described, by way of example only, with reference to the attached Figures, wherein.

DETAILED DESCRIPTION OF THE INVENTION

Figure 1:
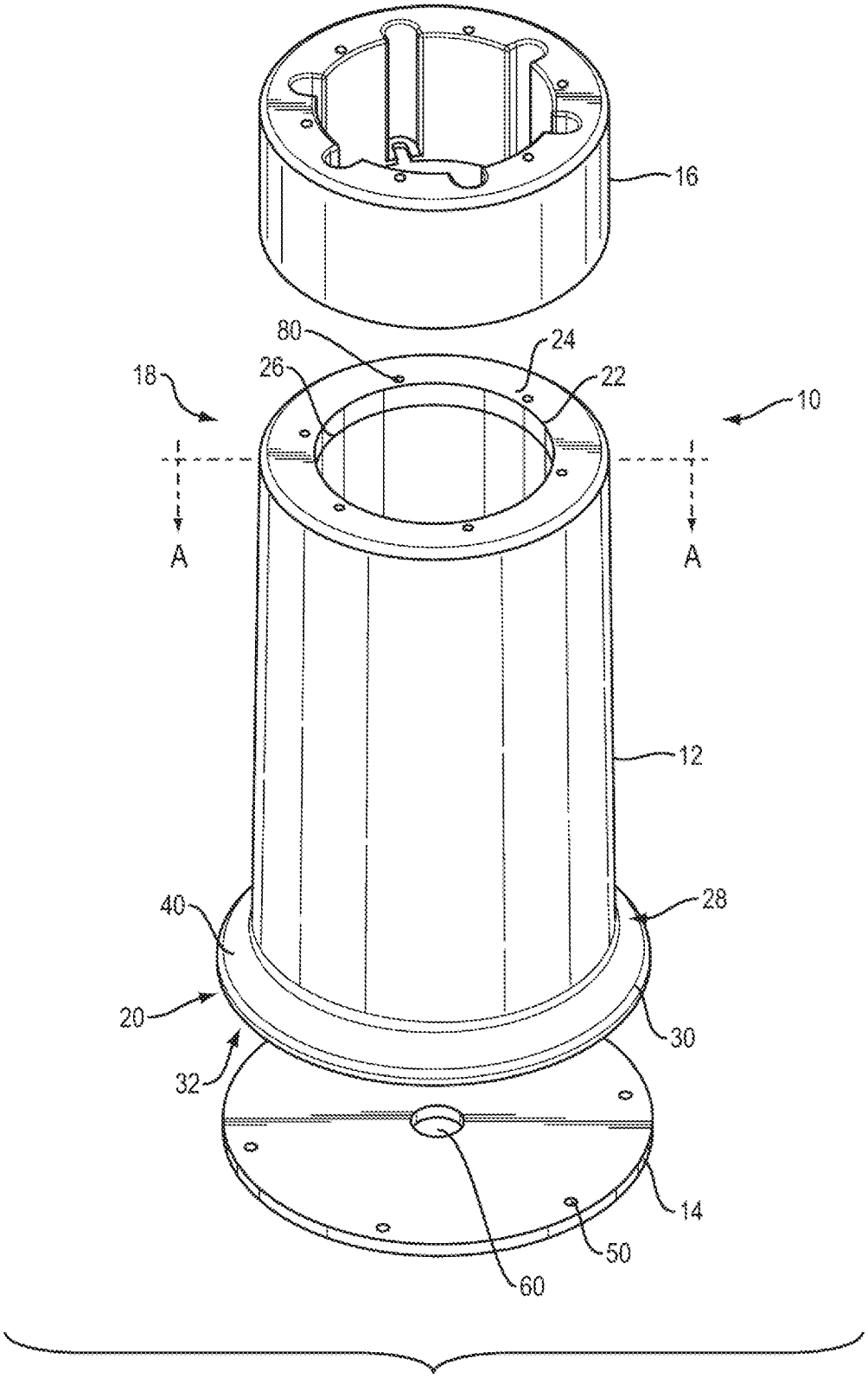
FIG. 1 shows an exploded perspective view of a light base with an extension member and base plate according to an aspect of this invention.

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments, as the skilled artisan would recognize, even if not explicitly stated herein.

Descriptions of well-known components and processing techniques may be omitted to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The preferred embodiment is described for use at airports by installing the light bases adjacent to runways and tarmacs for mounting specialized lighting to assist pilots in landing and maneuvering planes about the airport. However, the features of the light base disclosed herein is equally applicable to other in-ground light base applications.

Figure 2:
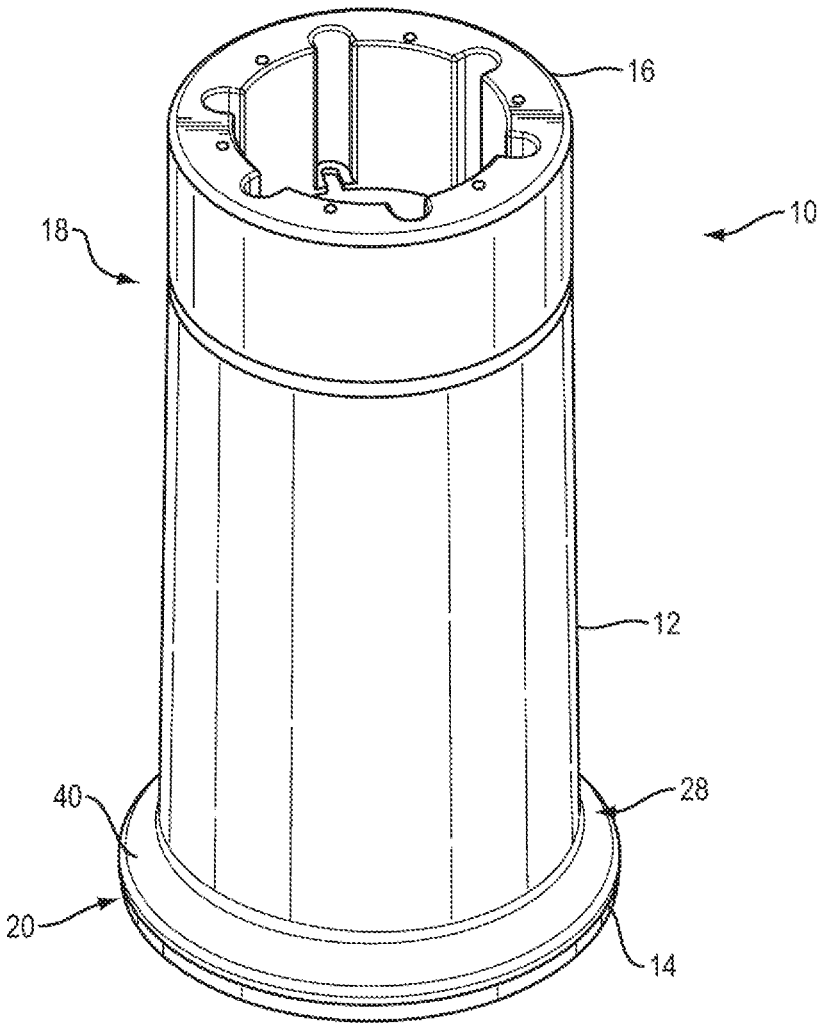
FIG. 2 shows a perspective view of the light base with the extension member and base plate of FIG. 1 in assembled form.

A light base 10, according to an aspect of this invention, is depicted in an exploded perspective view in FIG. 1 to comprise, hollow cylindrical body member 12, circular base plate 14, and an optional extension member 16. Referring to FIG. 2, light base 10 is depicted in a perspective view with the hollow cylindrical body member 12, circular base plate 14, and optional extension member 16 in an assembled configuration. As described above, light base 10 may be configured to be installed in the ground and to receive a light fixture (not shown) to be mounted thereon for use in various applications, including runway and tarmac lighting at airports.

Figure 4:
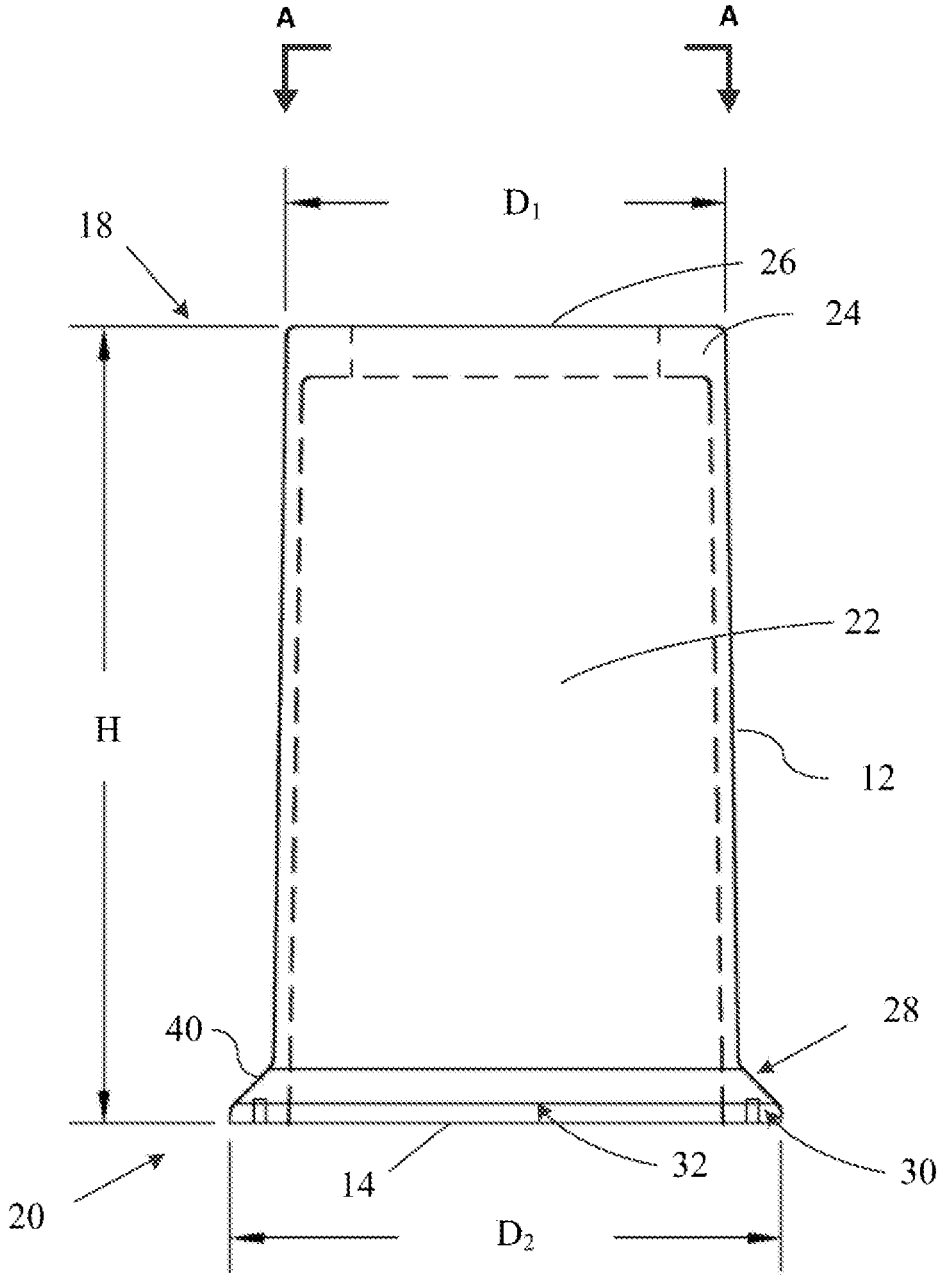
FIG. 4 shows cross-sectional view of the light base of FIG. 1, taken along line A-A.

Continuing to refer to FIGS. 1 and 2, and to a cross-sectional view of light base 10 in FIG. 4, hollow cylindrical body member 12 having a first or top end 18, a second or bottom end 20, opposite first end 18, and an interior region 22, between the first and second ends. The first end 18 may include a first circular flange 24 defining a first opening 26 in communication with the interior region 22 of body member 12. The second end 20 may include a base member 28 having a second circular flange 30 (visible in FIG. 4), defining a second opening 32, which is also in communication with the interior region 22 of body member 12. It should be noted that light base 10 may be formed with a body member 12 having shapes other than a cylinder, such as a cube or the like.

Before describing the further structural aspects and features of the body member 12, base plate 14, and optional extension member 16, their material composition will be discussed. In contrast to prior art light bases, which are fabricated from metal, such as galvanized steel, the body member 12 (including the first circular flange 24, base member 28 and the second circular flange 30), base plate 14, and an optional extension member 16 may be formed of polymer concrete. By using polymer concrete as the main structural material for light base 10, the corrosion problems described above with regard to the prior art light bases formed of steel are eliminated. As a result, the useful lifespan of the light base according to this invention will be significantly increased.

Polymer concrete is a composite material which may consist of a low viscosity polymer resin, such as polyester and/or vinylester resin, mixed with different aggregates, including one or more of rock, sand, and calcium. In one embodiment, the polymer resin may be mixed with all three of these aggregates. In a preferred embodiment, the polymer concrete may be made of quartz aggregate combined with a polymer resin. In addition, to provide more structural integrity, layers of fiberglass, various plastics, or other suitable materials, may be included and the polymer concrete may be sandwiched between such layers. In a preferred embodiment, interior and/or exterior reinforcement may be provided with woven fiberglass cloth of a weight which may range in weight from 6 ounces/yd$^2$ to-18 ounces/yd$^2$. A wet polymer concrete may be mixed, poured into a mold for the particular component shape and once the concrete cures, the light base, extension member, and/or the base plate may be removed from the mold constituting a mechanically strong, cross-link bonded structure. The components will be molded using matched surface tooling for interior and exterior surfaces In comparison to concrete, using only cement as a binder, polymer concrete has improved chemical resistance, is stronger, and when it fails, it does not fail catastrophically. Additionally, polymer concrete has improved flexural and compressive strength. And, particularly with the addition of fiberglass, polymer concrete has better tensile performance as well. Further, polymer concrete has low permeability to water and good resistance against corrosion, as well as good long-term durability with respect to freeze and thaw cycles.

Referring again to FIG. 4, first circular flange 24 has an outside diameter, $D_1$, which may be less than the outside diameter, $D_2$, of base 28. In one example, outside diameter $D_1$ may be approximately 14 inches while outside diameter $D_2$ may be approximately 17 inches. Moreover, the outer wall of hollow cylindrical body member 12 from the top, at first circular flange 24, to the bottom, at the top of base member 28, is slightly tapered (e.g. approximately 1 degree). This taper facilitates easier removal of the cylindrical body member 12 from the mold after the polymer concrete is cured.

Additionally, base 28 may be tapered and increase in width from a first end, which is interconnected to the body member 12, to a second end to which the base plate 14 is interconnected. The tapered region of base 28 forms a tapered surface 40. At the second end of base 28, there may be formed on the bottom surface a second circular flange 30. By providing a wider (relative to the diameter of body member 12) and tapered base 28, this further increases ease of removal from a mold after the polymer concrete cures. Wider base 28 also provides a convenient point of attachment for base plate 14. Moreover, tapered base 28 provides better mechanical durability during winter when frost heaves place stresses and strains on the light base 10. This is accomplished since the soil surrounding the cylinder compresses around the taper of the enclosure.

It should be noted that in order to be able to effectively remove hollow cylindrical body member 12 from the mold, one end (either top end 18 or bottom end 20) must be open. In this embodiment, second opening 32 at end 20 is formed as an open end which may be closed by removable circular base plate 14 when installed. While there is an opening 26 at the top end 18, it is sized to fit the light fixture and is not sufficiently open to enable removal from a mold if the bottom end 20 were closed.

As shown in FIG. 1, base plate 14 may include a plurality of holes 50 (in this example there are six) which are aligned with a like plurality of holes in the second circular flange 30 of body member 12, which are not visible in the figures. Fastening means, such as screws, may be inserted through holes 50 to removably connect the base plate 14 to second circular flange 30 of body member 12. As shown in FIG. 1, base plate 14 may include a drain hole 60 to allow any water that may collect in the interior 22 of the light base 10 to drain into the ground.

Figure 3:
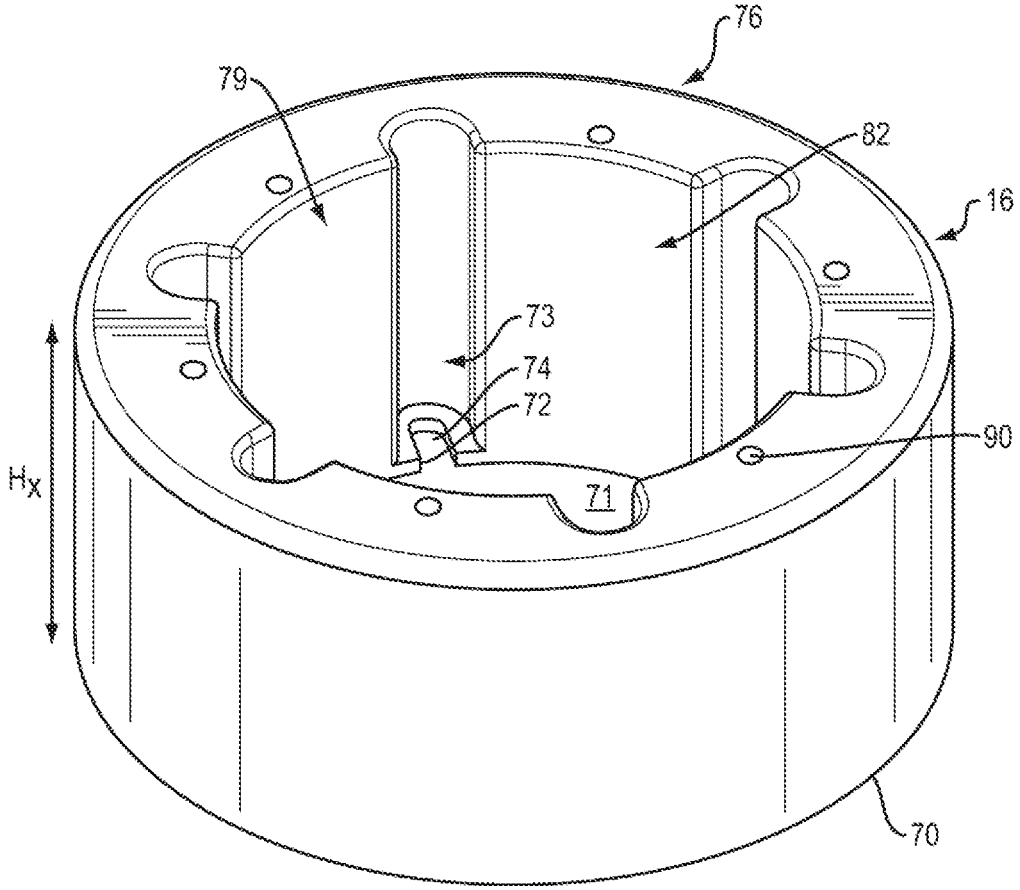
FIG. 3 shows an enlarged perspective view of the extension member of FIG. 1.

When assembled, light base 10, as shown in FIG. 4, has a height, H, which in this example may be approximately 24 inches. If additional height is needed, extension member 16, having a height, $H_x$, which may be varied, can be installed. This is described further below with regard to FIG. 3. As noted above, the diameter of light base 10, $D_1$, may be approximately 14 inches. However, light bases with other diameters, $D_1$, may be used, e.g. 12, 16, or 24 inches. The diameter will vary depending on the size of the canister required and will be relative to the nominal dimensions of the inner diameter.

If additional height is desired, hollow cylindrical extension member 16 may be added to body member 12 to increase the height from H to $H+H_x$. Extension member 16 may be configured to be removably affixed to the first circular flange 24 of body member 12 by mating circular flange 72 of end 70 of extension member 16 to circular flange 24 of body member 12. These components may be affixed by using fasteners, such as screws, passing through a plurality of apertures 74 in extension member 16 which are aligned with a like plurality of apertures 80 in body member 12 (FIG. 1). For ease of access to the fasteners which are passed through apertures 74 in extension member 16, channels, such as channel 73, which extend through flange 78 to aperture 74, may be included.

Extension member 16 may include another end 76 opposite end 70, about which may be formed of a circular flange 78. Circular flange 78 defines opening 79 while circular flange 72 at the opposite end 70 defines opening 71. Between openings 71 and 79 is interior region 82 of extension member 16. When extension member 16 is affixed to body member 12, opening 71 of extension member 16 is aligned with opening 26 of body member 12 and the interior region 82 of extension member 16 and interior region 22 of body member 12 are aligned and in communication with each other.

If the extension member 16 is not used, the plurality of apertures 80 on first circular flange 24 may be used to secure a temporary cover (not shown) or for installation of the light fixture. If the extension member is used, the plurality of apertures 90 on circular flange 78 may instead be used to secure the temporary cover or for installation of the light fixture.

Figure 5:
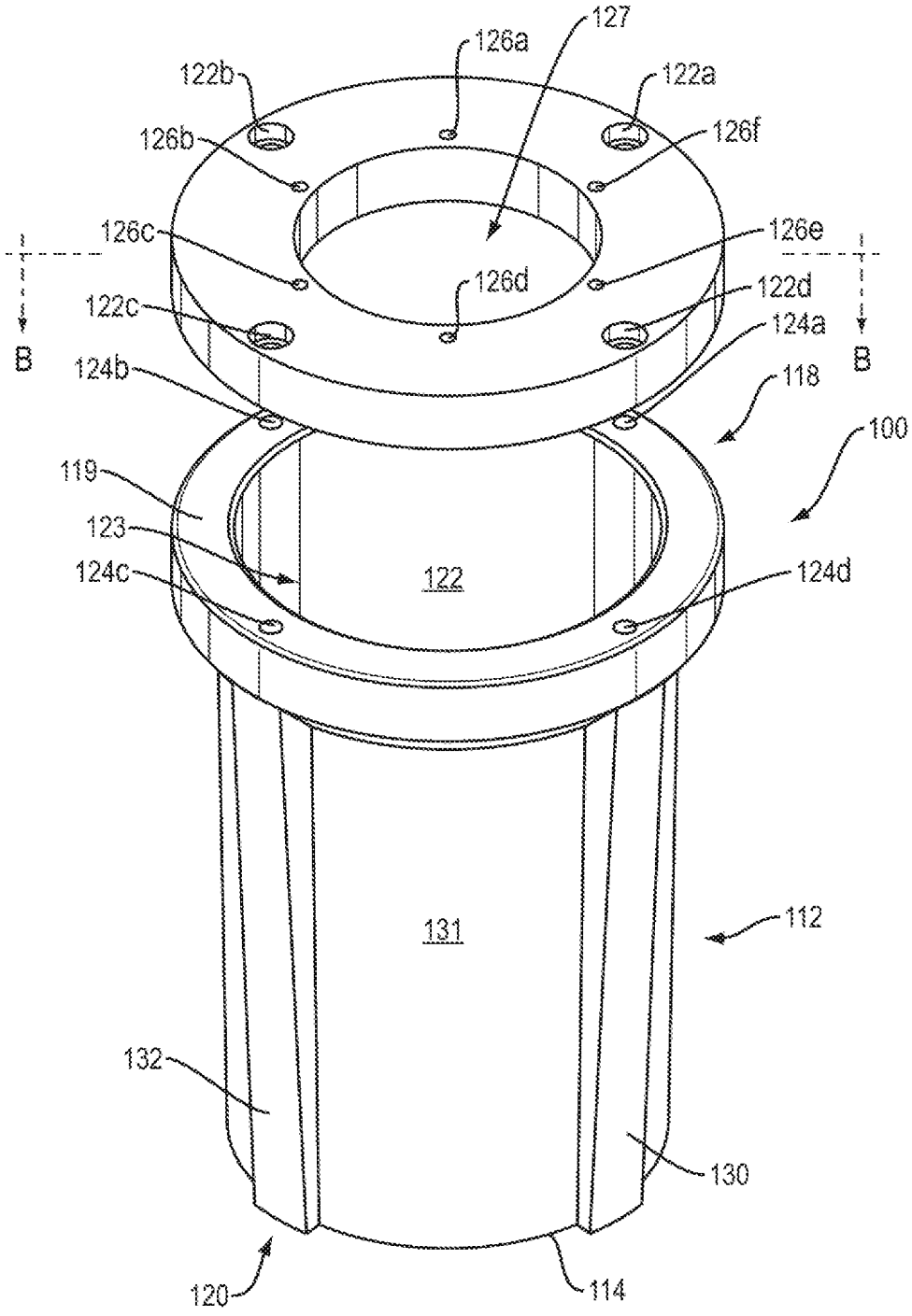
FIG. 5 shows an exploded perspective view of a light base according to another embodiment of this invention.
Figure 6:
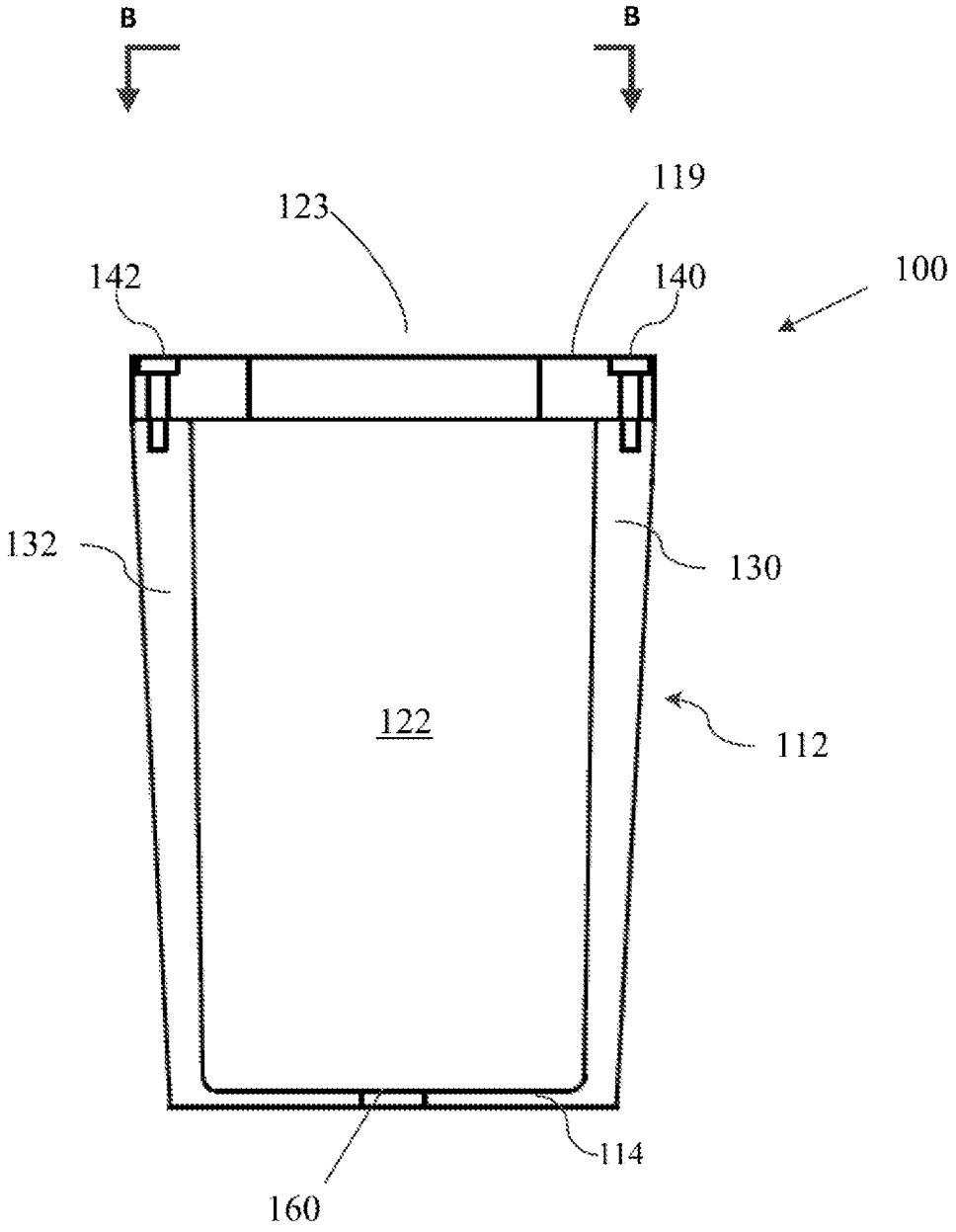
FIG. 6 shows cross-sectional view of the light base of FIG. 5, taken along line B-B.

Another embodiment of a light base according to this invention is shown in FIGS. 5 and 6. In these figures, light base 100 is depicted to comprise hollow cylindrical body member 112, a circular base 114, a circular flange 119, and a ring shaped cover member 121, all of which may be formed of polymer concrete. In this embodiment, circular base 114 is not a discrete component, as in the embodiment of FIGS. 1-4, but rather it is integrally formed as part of the hollow cylindrical body member 112.

Moreover, in this embodiment, circular flange 119 does not directly receive for mounting thereon a light fixture as is the case in the embodiment of FIGS. 1-4. Instead, circular ring shaped cover 121 is mounted on the top surface of circular flange 119 and is configured to receive a light fixture to be mounted thereon. Circular ring cover 121 may be secured to circular flange 119 by means of fasteners, such as screws, which pass through holes 122*a*, 122*b*, 122*c*, and 122*d* spaced about circular ring cover 121 and into a like plurality of aligned holes (124*a*, 124*b*, 124*c*, 124*d*) in the top surface of circular flange 119. Circular ring cover 121 may include opening 127 configured to receive a light fixture, which may be secured to light base 100 by inserting mounting screws from the light fixture into holes 126*a-f*, positioned about opening 127.

As described above, in order to be able to effectively remove hollow cylindrical body member 112 from a mold when it is being manufactured, one end (either top end 118 or bottom end 120) must be open. Since circular base 114 is integrally formed with cylindrical body member 112, first/top end 118 must have a sufficiently wide opening 123 to ensure proper removal from the mold when cured. However, opening 123 is then too large to receive a light fixture, so circular ring cover 121 may be included to receive the light fixture. The size of opening 123 may be adjusted depending on the size/type of the light fixture desired.

Outer wall 131 of hollow cylindrical body member 112, from near top end 118, below circular flange 119, to the bottom end 120, is slightly tapered (e.g. approximately 1 degree) inwardly, such that the diameter of outer wall 131 at bottom end 120 is smaller than the diameter of outer wall 131 near top end 118, below circular flange 119. This taper facilitates easier removal of the cylindrical body member 12 from the mold after the polymer concrete is cured.

Disposed circumferentially about the outer surface 131 and extending in the longitudinal direction of the cylindrical body member 112 may be ribs 130 and 132. Two additional ribs may also be included, but they are not visible in the figures, as they are disposed on the back side of cylindrical body member 112. Each rib may be aligned with a respective hole 124*a-d* in the top surface of flange 119. The thickness of the ribs may decrease from the first end to the second end of the hollow body member. The ribs provide a structure for the fasteners holding the circular ring cover 121 in place to attach, as more clearly shown in FIG. 6, and they improve the structural integrity of the cylindrical body member 112. The ribs are also beneficial during the molding process as they form channels (between each pair of ribs) for the polymer concrete to better flow to the base of the mold and into the mold section forming circular flange 119. Cylindrical body 112 is formed in a mold upside down, i.e. with bottom end 120 at the top of the mold and top end 188 at the bottom of the mold. Therefore, circular flange 119 is at the bottom of the mold and improving flow of the polymer concrete throughout the mold results in a better formed component.

Referring again to FIG. 6, fasteners 140 and 142 can be seen disposed in holes 124*d* and 124*c*, respectively, in circular flange 119 and into holes formed in ribs 130 and 132. Also depicted is drain hole 160 in circular base 114 allow any water that may collect in the interior 122 of the light base 100 to drain into the ground.

Figure 7:
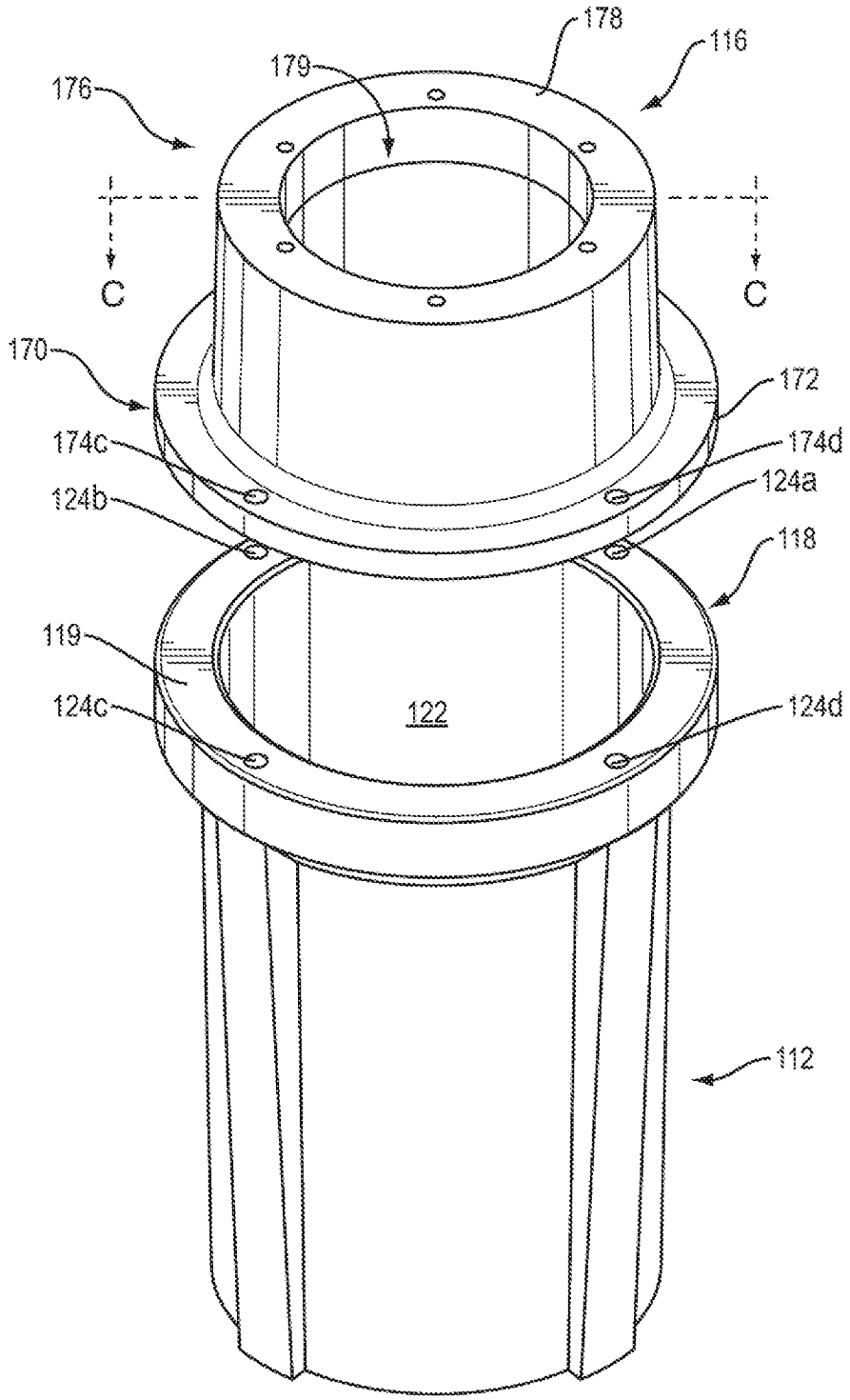
FIG. 7 shows an exploded perspective view of the light base of FIG. 5 with an extension member.
Figure 8:
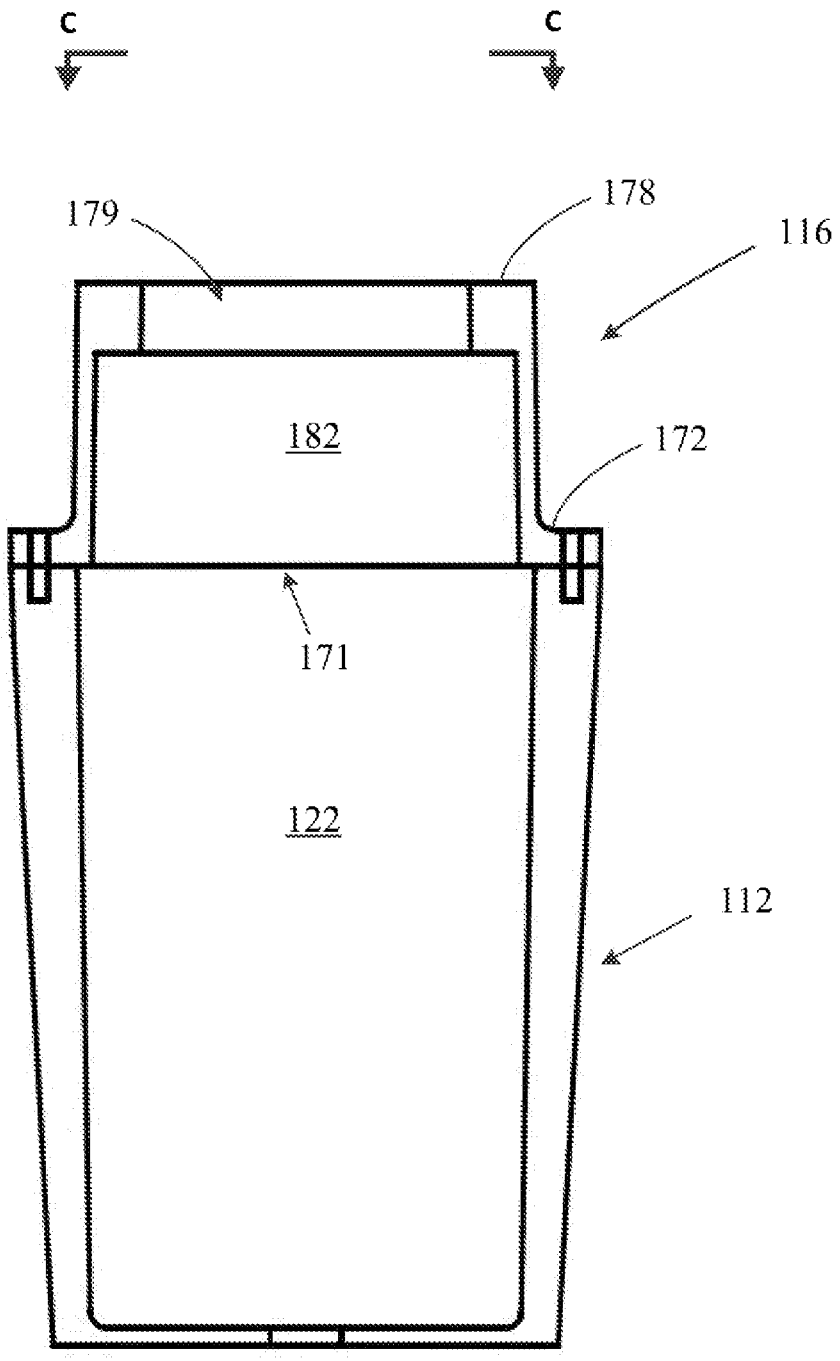
FIG. 8 shows cross-sectional view of the light base of FIG. 7, taken along line C-C.

As with the embodiment of FIGS. 1-4, if additional height is desired, hollow cylindrical extension member 116 may be added to body member 112, as depicted in FIGS. 7 and 8. Extension member 116 may be configured to be removably affixed to circular flange 119 of body member 112 by mating circular flange 172 of end 170 of extension member 116 to circular flange 119 of body member 112. These components may be affixed by using fasteners, such as screws, passing through a plurality of apertures 174*a-d* (apertures 174*a-b* are not visible) in extension member 116 which are aligned with a like plurality of apertures 124*a-d* in circular flange 119 of body member 112. (FIG. 1).

Extension member 116 may include another end 176 opposite end 170, about which may be formed of a circular flange 178. Circular flange 178 defines opening 179 while circular flange 172 at the opposite end 170 defines opening 171. Between openings 71 and 79 is interior region 182 of extension member 116. When extension member 116 is affixed to body member 112, opening 171 of extension member 116 is aligned with opening 123 of body member 112 and the interior region 182 of extension member 116 and interior region 122 of body member 112 are substantially aligned and in communication with each other.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

We claim:

1. A light base configured to be installed in the ground and to receive a light fixture to be mounted thereon, the light base comprising: a hollow cylindrical body member having a first end, a second end opposite the first end, and an interior region between the first and second ends; wherein the first end includes a first opening which is in communication with the interior region and which is configured to receive a light fixture; wherein the first end includes a first circular flange formed of polymer concrete which defines the first opening and the second end includes a base member; wherein the hollow cylindrical body member is formed of a polymer concrete material and an outside diameter of the hollow cylindrical body member is tapered and increases from the first end to the second end; and wherein an outside diameter of the first circular flange is less than an outside diameter of the base member.

2. The light base of claim 1 wherein the outside diameter of the base member is tapered and increases from a first end of the base member to a second end of the base member, and wherein the second end of the base member is proximate the second end of the hollow cylindrical body member.

3. The light base of claim 2 further including a base plate configured to be removably connected to the hollow cylindrical body member at the second end.

4. The light base of claim 3 wherein the base plate includes an aperture therein to drain liquid contained in the interior region of the hollow body member.

5. The light base of 1 further including a hollow cylindrical extension member configured to be removably affixed to the first circular flange to extend a length of the hollow cylindrical body member.

6. The light base of claim 5 wherein the hollow cylindrical extension member includes a third end, a fourth end opposite the third end, and an interior region between the third and fourth ends; and wherein the third end includes a circular flange configured to mate with the first circular flange of the hollow cylindrical body member when the hollow cylindrical extension member is removably affixed to the first circular flange.

7. The light base of claim 3 wherein the second end includes a second circular flange; and wherein the second circular flange defines the second opening in the hollow cylindrical body member in communication with the interior region.

8. The light base of claim 7 wherein the second flange is formed of polymer concrete.

9. The light base of claim 8 wherein the base member includes the second circular flange.

10. The light base of claim 9 wherein the base plate is configured to be removably affixed to the second circular flange.

11. A light base configured to be installed in the ground and to receive a light fixture to be mounted thereon, the light base comprising: a hollow cylindrical body member having a first end, a second end opposite the first end, and an interior region between the first and second ends; wherein the first end includes a first opening which is in communication with the interior region and which is configured to receive a light fixture; wherein the hollow cylindrical body member is formed of a polymer concrete material; wherein an outside diameter of the hollow cylindrical body member is tapered and decreases from the first end to the second end; and wherein the hollow cylindrical body member includes an outer surface on which are disposed a plurality of polymer concrete ribs extending in a direction substantially parallel to the longitudinal axis of the hollow cylindrical body member.

12. The light base of claim 11 wherein the first end includes a first circular flange on which is removably mounted a circular ring cover having formed therein the first opening.

13. The light base of claim 12 wherein the first circular flange and the circular ring cover are formed of polymer concrete.

14. The light base of claim 13 further including a base integrally formed at the second end of the hollow body member.

15. The light base of claim 14 wherein the base includes an aperture therein to drain liquid contained in the interior region of the hollow body member.

16. The light base of claim 12 further including a hollow cylindrical extension member configured to be removably affixed to the first circular flange to extend a length of the hollow cylindrical body member.

17. The light base of claim 16 wherein the hollow cylindrical extension member includes a third end, a fourth end opposite the third end, and an interior region between the third and fourth ends; and wherein the third end includes a circular flange configured to mate with the first circular flange of the hollow cylindrical body member when the hollow cylindrical extension member is removably affixed to the first circular flange and the third end includes the first opening.

18. The light base of claim 11 wherein each of the plurality of ribs have a thickness which decreases from the first end to the second end of the hollow cylindrical body member.

* * * * *